US005547361A

United States Patent [19]

Baker

[11] Patent Number: 5,547,361

[45] Date of Patent: Aug. 20, 1996

[54] TOOLING FOR FACING A WALL

[76] Inventor: Colin A. Baker, 44 Parvills, Waltham Abbey, Essex EN9 1QG, United Kingdom

[21] Appl. No.: 325,862

[22] Filed: Oct. 19, 1994

Related U.S. Application Data

[62] Division of Ser. No. 52,565, Apr. 23, 1993, Pat. No. 5,391, 331.

[30] Foreign Application Priority Data

Sep. 21, 1992 [GB] United Kingdom ..... 9219867

[51] Int. Cl.[6] ..... B28B 7/14; B28B 11/08

[52] U.S. Cl. ..... 425/171; 30/305; 249/15; 249/16; 249/53 R; 249/60; 249/102; 425/218; 425/299; 425/458

[58] Field of Search ..... 425/218, 295, 425/458, 299, 298, 169, 171, 383, 182, 196; 404/89, 93; 249/15, 16, 53 R, 60, 102; 30/304, 305

[56] References Cited

U.S. PATENT DOCUMENTS

| | | | |
|---|---|---|---|
| Re. 20,985 | 1/1939 | Knight | 264/334 X |
| 1,564,578 | 12/1925 | Kennedy | 264/33 |
| 1,583,516 | 5/1926 | Anfield | 264/245 X |
| 1,591,840 | 7/1926 | Kelly | 425/458 |
| 1,697,902 | 1/1929 | Burke | 30/305 |
| 1,888,234 | 11/1932 | Miller | 264/35 |
| 2,513,648 | 7/1950 | Iezzi | 249/16 |
| 2,595,142 | 4/1952 | Herck | 264/34 |
| 2,748,443 | 6/1956 | Dufford | 264/33 |
| 2,810,180 | 10/1957 | Barnack | 264/33 |
| 3,096,195 | 7/1963 | Seman et al. | 264/256 X |
| 3,222,436 | 12/1965 | Woodworth | 264/35 |
| 3,332,187 | 7/1967 | Arcari | 264/279.1 X |
| 3,630,249 | 12/1971 | Brunwin | 30/305 |
| 4,131,406 | 12/1978 | Fresquez | 425/385 |
| 4,231,677 | 11/1980 | Roming | 404/89 |
| 4,703,564 | 11/1987 | Cornelius | 33/518 |
| 4,776,723 | 10/1988 | Brimo | 425/458 |
| 4,828,426 | 5/1989 | Hendricks et al. | 404/93 |
| 5,169,573 | 12/1992 | Tsuchida et al. | 264/256 X |

FOREIGN PATENT DOCUMENTS

| | | | |
|---|---|---|---|
| 2622771 | 5/1989 | France | 425/298 |
| 52-59922 | 5/1977 | Japan . | |
| 281524 | 12/1927 | United Kingdom | 30/305 |
| 2111897 | 7/1983 | United Kingdom . | |
| 2176826 | 1/1987 | United Kingdom . | |
| 2208883 | 4/1989 | United Kingdom . | |
| 2258000 | 1/1993 | United Kingdom . | |

*Primary Examiner*—Robert Davis

*Attorney, Agent, or Firm*—Woodcock Washburn Kurtz Mackiewicz & Norris

[57] ABSTRACT

Tooling for facing a wall includes a plurality of cavities which are formed by four blades, each of the cavities corresponding to various brick sizes. Six lines of interconnected cavities are attached to a cross beam. Adjacent cavities and lines are spaced from another by a predetermined dimension. Unset settable building material is mixed with appropriate colouring and waterproofing agent and is applied to a wall to form an outer layer. The surface thereof is sponged to produce a brick like surface relief. The tooling is pressed into the outer layer to impress a pattern resembling brickwork. Unset material is sucked from the joint line space between adjacent cavities and the layer is allowed to set. Then, mortar is added to the joint line. Once the mortar has set, the final outer layer has a true brick finish that resembles a real brick wall. The unset settable material can be applied to damaged or wood walls so that a true brick finish can be given to a wall in a quick, simple and cost effective manner.

19 Claims, 3 Drawing Sheets

TOOLING FOR FACING A WALL

This is a division, of application Ser. No. 08/052,565, filed Apr. 23, 1993, which issued as Ser. No. 5,391,331 on Feb. 21, 1995.

BACKGROUND OF THE INVENTION

The present invention relates to a method for facing a surface such as a wall, and tooling for such facing. The term wall is to be construed broadly and comprises a vertical construction made of stone, brick, wood etc.

DESCRIPTION OF THE PRIOR ART

Walls can take many forms according to local preference and climate. For example, some buildings have walls comprising wood. However, unless wood walls are carefully maintained, they can be subject to weather damage resulting in damp together with a loss of insulation properties and deterioration in their appearance. In addition, wood walls can constitute a fire hazard giving problems with building insurance.

Another alternative is to have the walls of buildings made from bricks. In the United Kingdom, as in many countries, brick walls are considered desirable and have been used for a long time in the construction of buildings. Indeed, whilst in the recent past there was a trend towards more concrete based walls, currently this trend has been strongly reversed with a large demand for a brick appearance. Thus, for example, many office buildings are constructed of a breeze block, concrete or metal inner shell with an outer brick facing shell.

However, there are a number of problems with brick walls as such. The labour costs for construction of brick walls are high, partly due to the necessary skill required to lay bricks and partly due to the relatively slower construction time compared with other methods. Also, compared with, say, Victorian bricks, modern bricks are relatively soft and do not have such a high resilience to the climate and it has been found that the quality of the outer facing surface of the brick can decay quite rapidly. Furthermore, the cost of modern bricks is high compared with other building materials that can be used in the construction of new walls.

The problem of brick decay also starts to arise with older building stock, for example in buildings built more than 50 years ago. Consequently, many older buildings can look run down with penetrating damp and cold. Thus, unless expensive repair work is made to the facing brick work, such as pointing and replacing worn and damaged bricks, this process of decay can accelerate. Indeed, knocking the building down and rebuilding can often be cheaper than repair.

An alternative to the aforementioned repair work has been to cover the surface of the damaged brickwork with a coat of sand and cement. However, the dull grey appearance of such a rendered surface is not normally considered very attractive or desirable. Consequently, a pebble dash effect can be made by casting pebbles at the render whilst wet, which is very messy, or alternatively the rendered surface can be painted. Unfortunately, like most exterior painted surfaces, it has been found to be necessary to regularly repaint the rendered or pebbled surface to maintain its appearance. Thus, either the appearance degrades rapidly or frequent further expenditure is required.

SUMMARY OF THE PRESENT INVENTION

It is an object of the present invention to provide a method and tooling for facing wall surfaces which overcomes the aforementioned problems.

According to one aspect of the present invention, there is provided a method of forming a layer of material on a surface, the method comprising the steps of:

(a) applying a layer of unset settable building material to said surface; and (b) impressing into the unset settable material a pattern resembling brickwork.

Thus, a wall, be it newly constructed Of inexpensive building materials, or a wood wall or a decayed wall, can be used as a base onto which a layer of inexpensive unset settable building material can be applied. Then, the layer is impressed with a pattern resembling brickwork so that the surface looks like a true brick wall. The present invention requires less skilled labour than for building a real brick wall and is much quicker than say conventional brick laying or repair so that a brick like surface on the wall can be quickly and inexpensively obtained. By suitable selection of the building material, a high quality finish to the surface can be obtained and the heat insulation and waterproof properties of the surface can be improved.

It is preferred that the method includes the step of applying a pre-layer of a building material to said wall surface before step (a). This helps build up a good key for the final layer in which the brickwork pattern is impressed. Also, further pre-layers can be added to build up the thickness of the wall if necessary. This further assists in the heat insulation properties of the finished wall.

Conveniently, the pre-layer includes waterproofing. This further assists in preventing damp ingress through the wall.

The method also preferably comprises the additional step of:

(c) removing unset settable building material from a joint line in said pattern resembling brickwork.

Conveniently, step (c) comprises sucking the unset material from said joint line.

Therefore, if the unset settable building material is removed from the joint line, it is possible to have the final mortar line more recessed relative to the surface of the wall so that the final surface has an even better resemblance to a true brick finish. By the use of suction, it is possible to rapidly remove the unset building material from the joint line further improving the speed of forming the layer of material on the surface. In addition, the material is removed in a clean manner with little mess, and indeed, by use of a suitable suction means, the removed material can be recycled.

The speed of removal of the unset material is further improved by locating at the joint line a suction nozzle having a dimension substantially less than the joint line, conveniently, the suction nozzle has a 20% smaller dimension relative to the width of the joint line. Since during step (b) a line is effectively cut in the unset material to define each brick, locating the suction nozzle at the joint line, sucks the unset material away from the cut edge making for quick and easy removal of the unset material.

It is preferred that the method comprises the additional step of:

(d) applying mortar to said joint line after step (c).

This further improves the appearance of the surface so that its resemblance to a true brick wall is greater. Mortar can also be inserted into the joint line to a thickness sufficient to satisfy the requirements of building regulations applying to the construction of walls, e.g. the relevant British Standard.

Another particularly advantageous feature of the present invention is the step of adding colouring additive to the unset settable building material of step (a). Consequently, not only can the pattern resemble brickwork, but the colour of the brickwork can also be matched. Frequently, with old houses and for restoration, it is very difficult and expensive to match up brick colour. With the present invention, it is just a matter of adding the correct colouring. The addition of the colouring allows the present invention considerable flexibility in its use and considerable consumer choice on the final surface appearance and enables matching to existing brickwork. Furthermore, since the colouring is added to the building material, the colour resides in the material rather than in paint work. Thus, there is no maintenance in terms of painting required.

Preferably, said layer of material applied in step (a) is sponged prior to step (b) or a stencil is applied to said layer of material in step (a) prior to step (b) to give a surface relief to the layer which resembles a predetermined brick surface relief. In this way, the resemblance of the finished surface to a true brick finish is further improved making it extremely difficult to tell if the surface of the facing is made from the present invention or has a real brick facing.

It is also preferred that said unset settable building material is made from a mixture including sand and cement. In this way, a very hard wearing yet cost effective surface can be produced, which surface is more hard wearing than many modern bricks. It can therefore be seen that with the present invention, a wall with a surface resembling a true brick finish, which imitates a real brick wall, can be inexpensively produced from durable materials.

According to another aspect of the present invention there is provided tooling for impressing a pattern resembling brickwork into a layer of unset settable building material applied on a wall surface, the tooling comprising:

a plurality of blades supported relative to one another whereby pressing into said layer of unset material is capable of building up a pattern resembling brickwork.

Thus, the present invention provides a tool for building up a pattern resembling brickwork with all the advantages mentioned above. The tool can be used by people having less skill than that required to construct a conventional brick wall.

The tooling may comprise two parallel blades which are provided for forming a joint line of the brickwork in the pattern resembling brickwork. Alternatively, the blades can be arranged to define a cavity for forming one brick of the brickwork in the pattern resembling brickwork. In yet another alternative, the blades can be arranged in a unit to define a plurality of cavities having a predetermined arrangement for forming a plurality of bricks of the brickwork in the pattern resembling brickwork. By simply lining up the various blades, a symmetrical brick pattern can be built up and the variety of tools allow the brickwork pattern to be built up around obstacle and up to awkward edges. In addition, considerable flexibility is possible in the type of brickwork pattern, for example arches and circles can be formed.

Conveniently, blades along at least one edge of said unit define a joint line. This aids lining up with a previous impression of the tooling in the layer of material. The joint width preferably has a width of 10 mm.

In one embodiment, the blades of said unit define two or more cavities arranged in a straight line. Thus, the pattern can be quickly built up. For ease of making the tooling, adjacent cavities are supported relative to one another by rods and the rods may be connected to blades of said cavities by rod release means.

In another embodiment, a number of said lines are provided in parallel, each line being attached to a handle portion. This also enables an increase in the speed of building up the pattern. Conveniently, for ease of assembly of the tool, said lines are connected to the handle portion by handle release means.

To allow removal of damaged blades, said rod release means and said handle release means may comprise nuts and bolts.

It is preferred that said tooling has a variety of brick dimensions defined by said cavities.

The blades may be arranged to define a cavity having an integral base plate to form an open ended box. This gives structural strength. The base plate preferably includes apertures to allow escape of air during impressing and prevents any suction effect when the tooling is removed from the layer of material on the wall.

To assist in making an accurate pattern, the tooling can include a spirit level, and to avoid corrosion the blades may comprise stainless steel.

According to another aspect of the present invention there is provided a hand held mortar application tool for applying mortar to a joint line in brickwork, the tool comprising:

a flexible bag for receiving unset building material; and a nozzle outlet connected to the flexible bag and insertable into the joint line whereby hand pressure applied to the bag can squeeze the unset building material from the nozzle into the joint line.

In this way, the mortar can be inserted into the joint line in a quick, easy, and clean manner with little waste compared with the prior art.

BRIEF DESCRIPTION OF THE DRAWINGS

Examples of the present invention will now be described with reference to the accompanying drawings, in which.

DETAILED DESCRIPTION OF THE DRAWINGS

Figure 1:
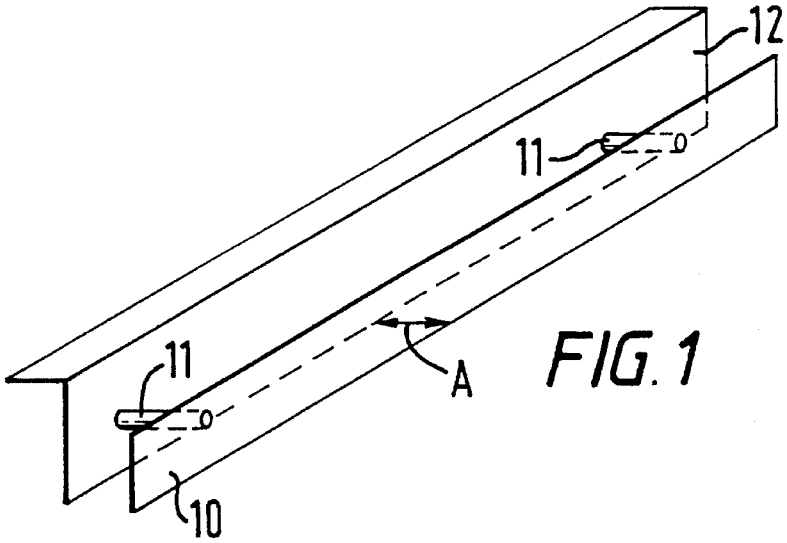
FIG. 1 illustrates an oblique perspective view of tooling embodying the present invention for building up a pattern resembling brickwork and which has two blades.

Components which are common between the drawings bear common reference numerals.

There are a large number of ways of constructing a known brick wall. For example, one method comprises assembling bricks such that pairs of bricks (stretchers) and half bricks extending parallel to the plane of the wall are alternately arranged with single bricks (headers) arranged perpendicular to the plane Of the wall. The bricks are arranged with mortar therebetween, which when set holds the bricks together. The joint line between each brick is either simply finished during the building of the wall, or more commonly extra mortar is inserted into the joint line and a tool of some sort is run along the joint line to give a neat finish.

The present invention will be described with reference to the appearance of such a brick wall construction but is not to be considered as limited to this specific appearance.

In addition, the present invention can be applied to facing any sound surface, including timber, and whilst the present invention will be described with reference to facing a brick wall surface, it is not to be considered as limited thereto.

Referring to FIG. 1, tooling embodying the present invention comprises a blade 10 formed from a planar strip of stainless steel. The blade 10 is rigidly connected by a pair of brass rods 11 to the longer side of an L-shaped blade 12 so that the blades are parallel, spaced apart a distance A and with their lower edges on a plane perpendicular to the blades, as illustrated. The dimension A is preferably the usual size of a joint line for receiving mortar in a wall built of bricks. In the United Kingdom, this dimension is typically 10 mm. The rods can be welded to fix the blades 10 and 12 together as shown or the rods can be threaded to receive nuts so that the blades are releasably connected. The blades preferably have a length equal to the length of a brick, typically 9.125 inches.

Figure 2:
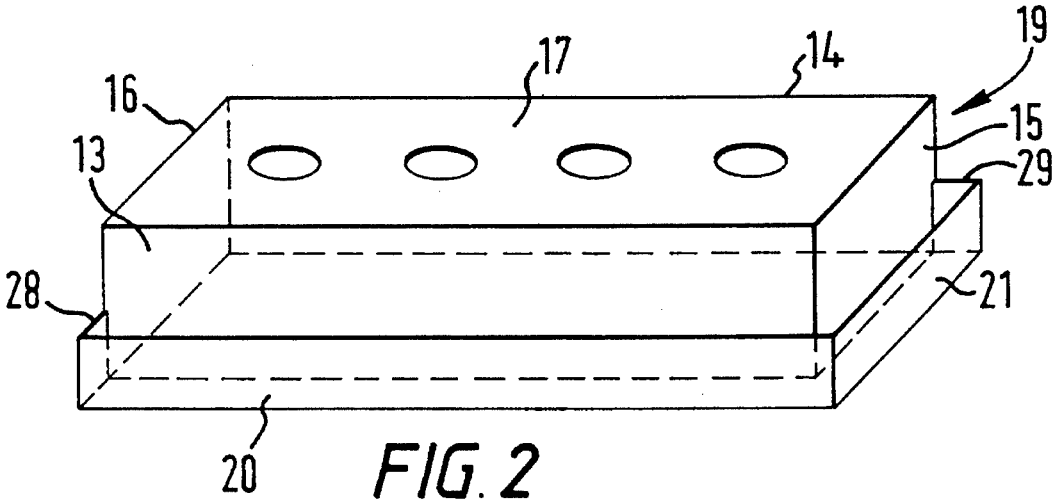
FIG. 2 illustrates an oblique perspective view of further tooling embodying the present invention for building up a pattern resembling brickwork and having one cavity.

Referring to FIG. 2, further tooling embodying the present invention comprises two relatively longer planar stainless steel blades 13 and 14 and two relatively shorter stainless steel blades 15 and 16 which are all connected to a base plate 17 to define an open ended cavity 19. The base plate 17 includes a pair of holes 18. The edges of the blades at the open end of the cavity 19, remote from the base plate 17, lie on a plane perpendicular to the blades 13 to 16 and define a rectangular area. It will be apparent that the open ended cavity described can conveniently be formed by welding or by a combination of metal bending and welding.

Parallel to and spaced from the blade 13 there is provided a further blade 20. A flange 28 at one end of the blade 20 is welded to the corner where blades 13 and 16 join. The other end of the blade 20 is welded to one end 0f a further blade 21. The blade 21 is parallel to and spaced from the blade 15 and a flange 29 at the other end of the blade 21 is welded to the corner where blades 14 and 15 join. The blades 20 and 21 are spaced from the blades 13 and 15 respectively by a distance A with their lower edges on the aforementioned plane of the blades 13 to 16. The dimension A is preferably the usual size of a joint line for receiving mortar in a wall built of bricks. In the United Kingdom, this dimension is typically 10 mm. The length of the blades 13 and 14 is illustrated to be equivalent to the length of a brick whereas the length of the blades 15 and 16 is selected to be equivalent to the width of a brick (hereinafter cavity 19A). However, the length of the blades 13 and 14 can be equivalent to half the length of a brick (hereinafter cavity 19B), or the length of the blades 13 and 14 can be equivalent to width of a brick (hereinafter cavity 19C).

Figure 3:
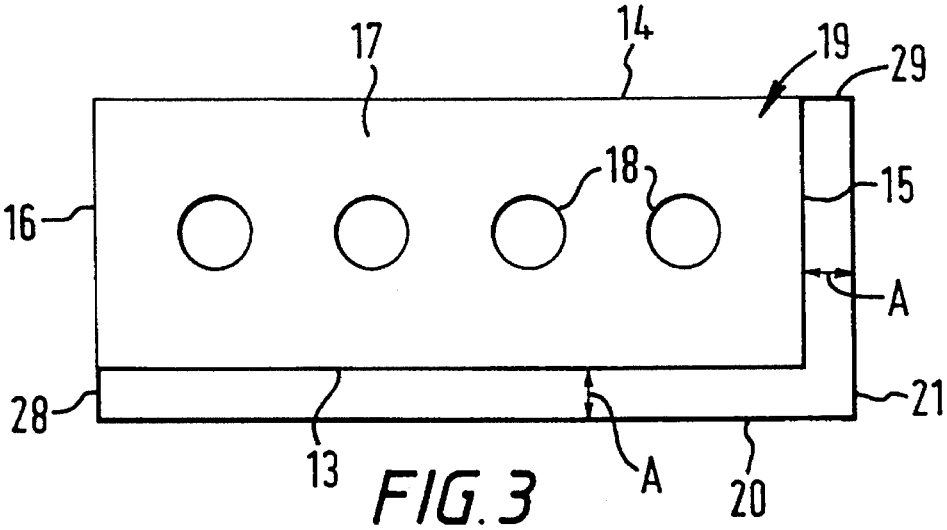
FIG. 3 illustrates a top plan view of the tooling shown in FIG. 2.
Figure 4:
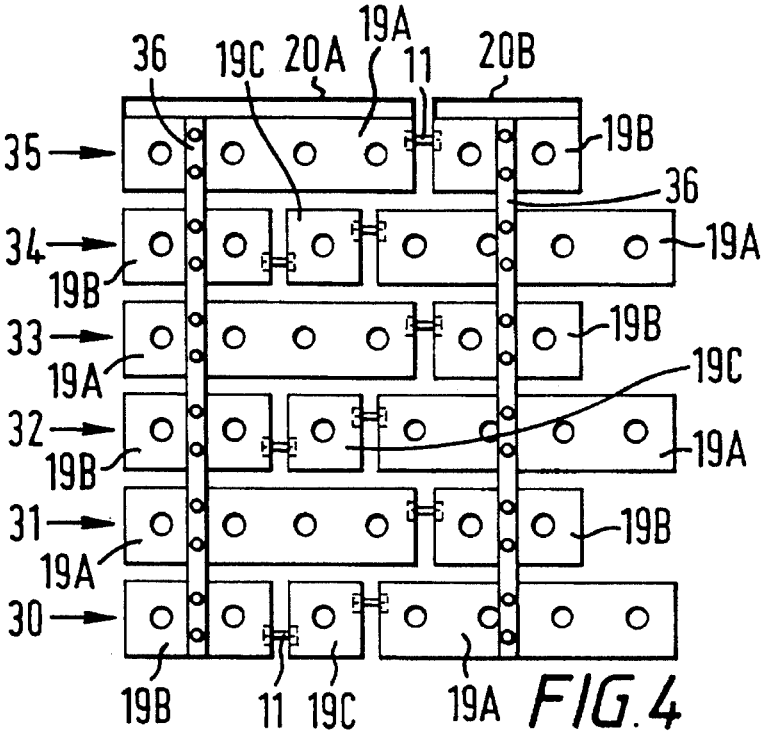
FIG. 4 illustrates a top plan view of still further tooling embodying the present invention for building up a pattern resembling brickwork and having a plurality of cavities with handles removed.

Referring to FIG. 4, further tooling embodying the present invention is shown. To make the tooling shown in FIG. 4, a number of cavities resembling that shown in FIGS. 2 and 3 are made without the blades 20 and 21 and with the length of the blades 13 and 14 varied. In a first line of cavities identified by line 30, there is provided a cavity 19B connected to a cavity 19C by a rod 11 which is in turn connected to a cavity 19A by a rod 11. In the next line of cavities identified by line 31, there is provided a cavity 19A connected by a rod 11 to a cavity 19C. Line 32 is the same as line 30 and line 33 is the same as line 31. Line 34 is the same as lines 30 and 32 and line 35 is the same as lines 31 and 33 except that blades 20A and 20B are provided on the respective cavities 19A and 19B. The adjacent cavities are mounted to be spaced by the dimension A.

Figure 5:
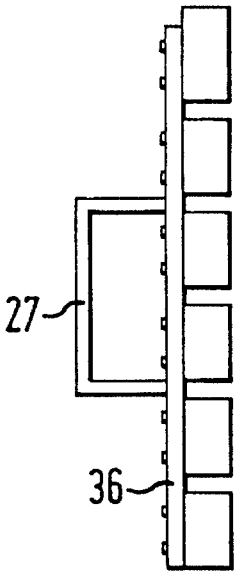
FIG. 5 illustrates a side view of the tooling shown in FIG. 4.

Towards the end of each line 30 to 35, a cross beam 36 is attached to the respective base plates of cavities by bolts so that the lanes 30 to 35 are rigidly connected with adjacent lines being spaced by the dimension A. It should be noted that not all cavities are attached to the cross beams since in this embodiment, some of the cavities are supported by the rods 11. This is not essential. In addition, the connection of the cross beams by means of bolts is preferred since it allows replacement of damaged cavities. Of course, the cross beams could be simply welded to the cavities. A handle 27 is connected in parallel with each cross beam to aid manual manipulation of the tooling as shown in FIG. 5. The handles 27 have been omitted from FIG. 4 for clarity.

Figure 6:
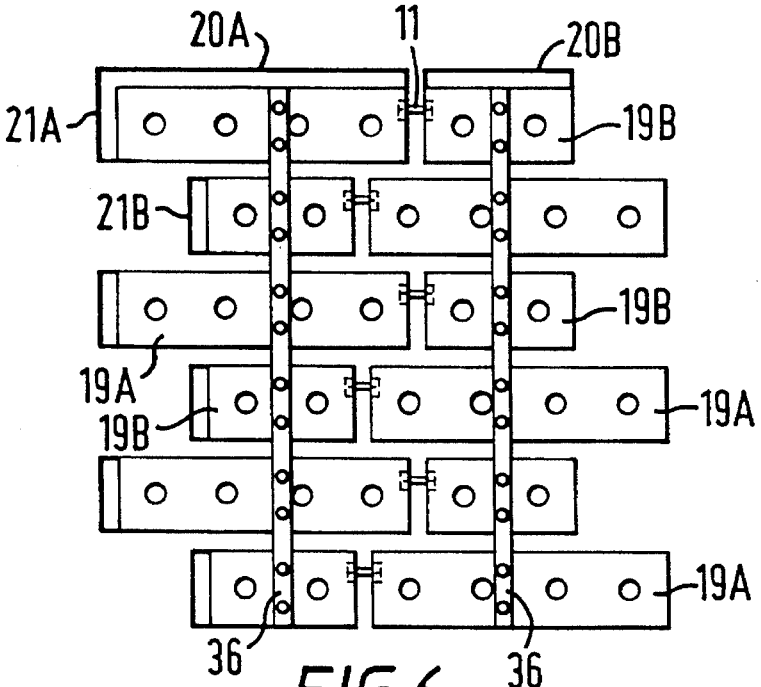
FIG. 6 illustrates a top plan view of yet further tooling embodying the present invention for building up a pattern resembling brickwork and having a plurality of cavities.

The arrangement of cavity size in each line and the arrangement of lines can be altered according to the type of brickwork pattern to be imitated. The tooling shown in FIG. 4 is for starting at one edge of a wall. FIG. 6 shows tooling for repeated application. The tooling comprises a repeat pattern of, from the left hand edge, a line comprising cavity 19A connected to cavity 19B and then a line, relatively offset from the previous line, comprising cavity 19B connected to cavity 19A. Three repeats of the pattern are shown in the tooling of FIG. 6. It should be noted that each cavity along the left hand edge includes a blade 21A or 21B to define a joint line.

In the example shown, the dimensions of the cavity are 2.75 inch×9.125 inch for cavity 19A to resemble a stretcher, 2.75 inch×4.625 inch for cavity 19B to resemble a half brick, and 2.75 inch×2.25 inch for cavity 19C to resemble a header.

The operation of present invention for a wall using, for example, the tooling described above will now be outlined.

If necessary, the wall is initially prepared. For example, loose material may be removed. Means for absorbing thermal expansion may need to be adhered to the wall, or the wall may simply need to be cleaned. For example, for wood, building paper and expanding metal would be required. In addition, a lining of some sort may be required, e.g. expanding metal and expansion joints for a concrete wall. It is preferred that a key coat or scratch coat of sand and cement is rendered onto the wall. A suitable waterproofing agent may be employed. This coat is left with a scored surface to assist adhesion of the next coat. A number of coats may be applied, if desired, to build up an appropriate thickness. These coats are allowed to dry prior to application of an outer coat.

For the outer coat, a settable building material such as sand and cement mixture is prepared. This may be selected for the appropriate job in hand, although it has been found that a Victorian mix comprising 6 parts sand and 1 part cement by volume, prior to mixing with water, is generally suitable and results in a hard wearing finish. In order to match existing colouring or to provide a finish representing a desired finish colour for the brickwork pattern, e.g. red brick, appropriate dyes are added into the sand and cement mixture.

When prepared, the unset mixture is coated onto the wall by a person in the usual manner of rendering to form an outer layer. A typical thickness is 0.25 inches to 1.00 inches. Once a reasonably level finish has been prepared, the unset surface can be rubbed gently with a wet sponge to slightly roughen the surface or a stencil, previously taken and made from existing brick, can be pressed lightly onto the surface.

Starting at one edge of the wall, a user holds the handles 27 of the tooling shown in FIG. 4 and manually manipulates the tooling to the correct position aligned with the wall edge. The tooling is then pressed into the unset outer layer thereby forming an impression in the outer layer of a pattern resembling brickwork.

The user then takes the tooling of FIG. 6 and lines up the left hand edge, as illustrated, with the right hand edge, as illustrated, of the impression already made in the outer surface. It should be noted that the blades 21A and 21B line up against the right most cut into the surface made by the tooling of FIG. 4. The tooling of FIG. 6 is then repeatedly impressed into the unset outer layer, interlocking with the adjacent previous impression, until an appropriate area of the wall has been impressed by the tooling so that the area has received the pattern resembling brickwork.

It should be noted that the blades 20A and 20B are lined up with a relatively higher area to which the brickwork pattern has already been applied. The area to which the tool is impressed can be selected as desired before the next step is performed. All the tooling can include an integral spirit level (not shown) to assist in maintaining the horizontal line of the pattern.

It should also be noted that the holes 18 assist the escape of air from the cavities as the tooling is applied to the outer layer to avoid air pressure denting or pressing out any surface relief and the holes 18 assist the ingress of air into the cavities during removal of the tooling from the outer layer so as to avoid any suction effect pulling the outer layer away from the underlying surface.

As the tooling is pressed into the outer layer, it can be held against the wall and the unset mixture can be scraped out of the spaces between the cavities to about the same depth as the tooling has been pressed into the outer layer or conveniently to the base underneath. Then the tooling can be removed from the wall. However, this is a messy, difficult and time consuming exercise.

Figure 7:
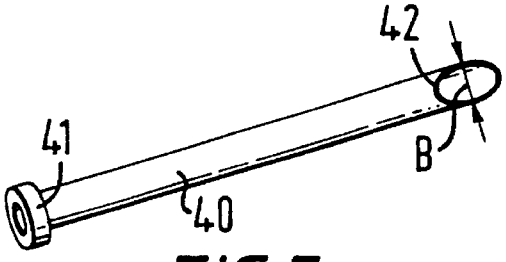
FIG. 7 illustrates a perspective view of a suction nozzle attachment.

As an alternative, the unset mixture is removed from the wall by means of a nozzle attachment 40 as shown in FIG. 7 which is connected to a portable suction unit (not shown) of the wet type where sucked material is stored in a metal body. The nozzle attachment comprises a tube having a connection 41 at one end for connection to the suction unit and with the other end 42 obliquely cut off. The cut off end 42 has a width B which is selected to be less than the dimension A, typically about 20% less.

Figure 8:
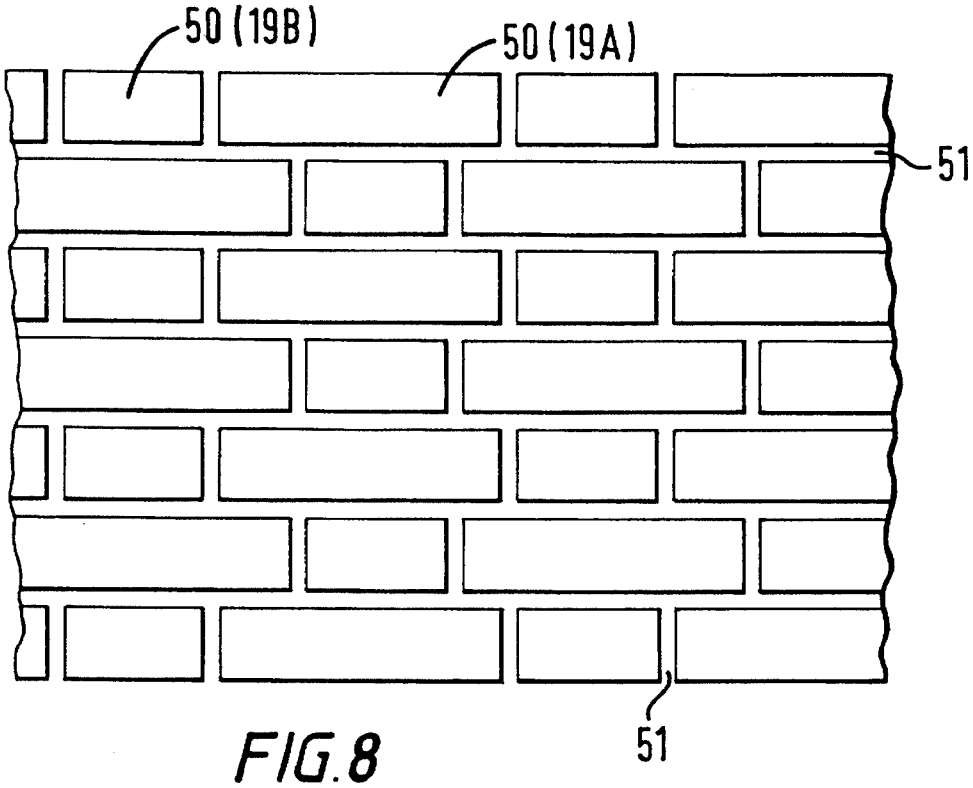
FIG. 8 illustrates a pattern resembling brickwork formed after impressing tooling embodying the present invention into a layer of unset settable building material.
Figure 9:
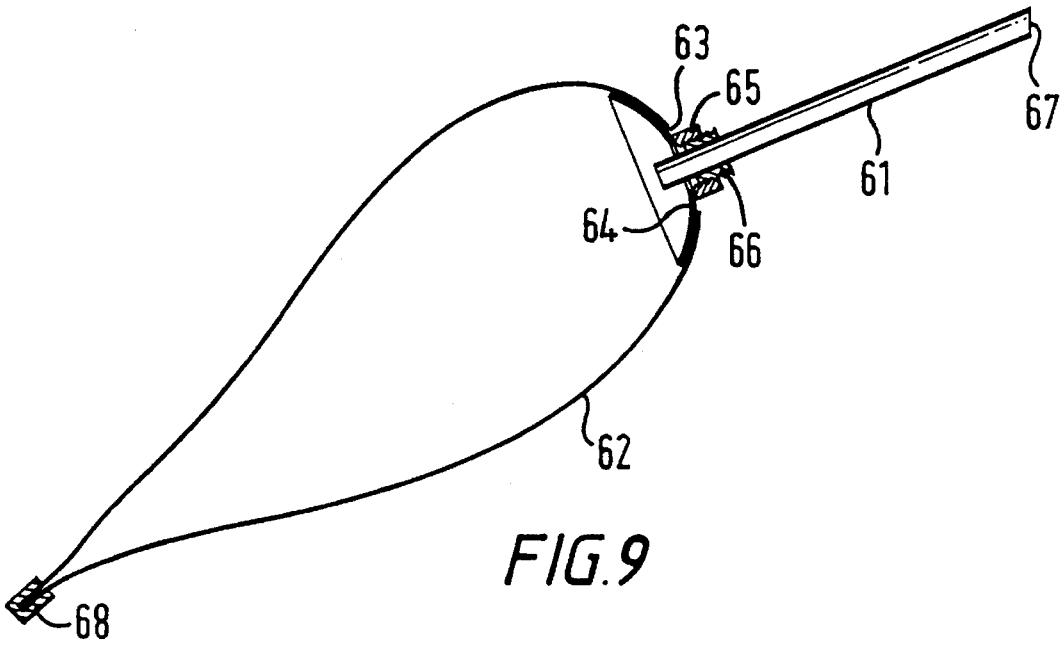
FIG. 9 illustrates a hand held mortar application tool embodying the present invention.

The blades of the cavities make a series of cuts into the outer layer. FIG. 8 illustrates the appearance of a portion of the outer layer after the tooling has been pressed into the layer. Each cavity has impressed a rectangular area 50 according to the size of the cavity which represents a brick. The areas 50 are spaced from one another by a joint line 51 between the bricks which comprises mortar in a real brick wall. The nozzle attachment is attached to the suction unit and the end 42 is drawn along each joint line. It has been found that by selecting the dimension B to be less than the dimension A, the still unset material can be sucked from the line 51 with the unset material being sucked away from the blade cut that defines the areas 50. By mounting the suction unit on the back of a user, the user can quickly and cleanly remove the unset material from the lines 51 without disturbing the areas 50 to leave an outer layer that resembles a real brick wall without the final finish of a mortar line. Moreover, the unset material can be reused to be applied to an unrendered part of the wall.

Once the outer layer has set, mortar can be inserted into the lines 51 in known manner. Preferably, the inserted mortar has a different colour to the areas 50.

A novel way has been found for inserting the mortar into the lines 51. This comprises a nozzle tube 61 having an open end 67 with a dimension for insertion into the line 51. The other end of the tube 61 opens into the interior of a bag 62 through an aperture 63 of the bag. A strengthening member 64 is provided to surround the aperture 63 and a threaded nut 65 is rotatably attached to a flange extending from the member 64. The nut 64 can screw onto a thread 66 formed on the outer surface of the tube 61 so that the tube 61 can be firmly attached to the bag 62. The bag has an opening which is closed by sliding on a closure member 68. The bag is collapsible and has a size to be conveniently held in the hand. The closure member 68 is removed and the bag is filled with mortar. When the closure member has been located on the bag to close it, a user inserts the nozzle end 67 into the lines 51 and by manually squeezing the bag, mortar can be inserted into the lines 51 in a quick, simple and tidy manner. The bag 62 is preferably refillable rather than having a one shot nature.

By running a suitable tool along the mortar applied to the lines 51, a pleasing appearance can be given to the mortar line. This improves the resemblance of the outer layer to the brickwork pattern of a desired real brick wall. The dimension A is selected so that when mortar is inserted into the joint line 51, the width of the mortar is sufficient to satisfy the building regulations which apply to wall construction, for example those used as the relevant British Standard. The level of the final mortar line can be recessed relative to the surface of the areas 50 if desired.

Once the mortar has set, the final outer layer has a true brick finish that resembles a real brick wall and indeed it is difficult to tell from the outer layer whether the surface is a conventional brick wall or a wall coated using the method and tooling of the present invention.

The tooling shown in FIGS. 1 to 3 are generally employed for finishing the pattern up to edges such as windows or roofs. However, they may also be employed for imitating unusual brick formations such as circles and arches. Nevertheless, they use the concept of a blade being impressed into unset settable building material to produce a pattern resembling brickwork.

It will be appreciated that the present invention is not limited to the embodiment described with reference to the drawings, and may take several different forms. In particular, the present invention is not limited to the tooling illustrated. In addition, the tooling need not consist of separately formed cavities fastened together, but may be formed as a single cast body. It will be apparent that the cavities are constructed of any suitable material which satisfies the requirements of durability and the necessity that the tooling is resilient, resistant to corrosion and hard wearing, for example stainless steel. It will also be quite apparent that the arrangement, size and selection of cavities can be freely chosen to impress a pattern resembling a desired brickwork and the present invention is not limited to the form of an alternating stretcher and header type of brickwork pattern. As examples there are basket weave, English bond, Flemish bond, Dutch bond, etc. The colours that can be added to the unset settable material can be varied, for example red, yellow, orange, brown, grey etc and this facility to colour the material allows widespread application of the present invention. The building material employed can also be varied as required and is not limited to the materials or proportions described.

The term brick as employed in this specification is to be construed as including a side view or end view of a brick or a half brick and it will be apparent that the wall to be rendered may be first constructed from relatively inexpensive building materials such as breeze blocks or wood. The present invention can also be applied to horizontal surfaces, and can also be applied to exterior and interior surfaces.

What we claim is:

1. A wall facing patterning tool for forming a brickwork resembling layer in a wall facing of unset settable building material, the tool comprising:

a plurality of rigid blades formed from planar sheet material; and means for supporting the blades relative to one another;

the thickness of the sheet material defining the thickness of the blade;

the thickness of the blade being such that the blades can slice into said unset settable building material without significant compression of the building material so as to form a plurality of cut lines therein;

the supporting means separating the blades by a predetermined distance such that said tool can produce said cut lines to form the edges of a joint line of the brickwork resembling layer.

2. The tool as claimed in claim 1 comprising two parallel blades.

3. A wall facing patterning tool for forming a brickwork resembling layer in a wall facing of unset settable building material, the tool comprising:

a plurality of rigid blades formed from planar sheet material; and means for supporting the blades relative to one another;

the thickness of the sheet material defining the thickness of the blade;

the thickness of the blade being such that the blades can slice into said unset settable building material without significant compression of the building material so as to form a plurality of cut lines therein;

the blades are arranged in a unit to form a plurality of cavities having a predetermined arrangement for forming a plurality of bricks of the brickwork resembling layer;

wherein parallel blades along at least one edge of said unit form a joint line.

4. The tool as claimed in claim 3 wherein said joint line has a width of about 10 mm.

5. A wall facing patterning tool for forming a brickwork resembling layer in a wall facing of unset settable building material, the tool comprising:

a plurality of rigid blades formed from planar sheet material; and means for supporting the blades relative to one another;

the thickness of the sheet material defining the thickness of the blade;

the thickness of the blade being such that the blades can slice into said unset settable building material without significant compression of the building material so as to form a plurality of cut lines therein;

the blades are arranged in a unit to form a plurality of cavities having a predetermined arrangement for forming a plurality of bricks of the brickwork resembling layer;

the blades of said unit form two or more cavities arranged in a straight line;

wherein the blades of adjacent cavities are supported relative to one another by rods.

6. The tool as claimed in claim 5 wherein said rods are connected to blades of said cavities by rod release means.

7. The tool as claimed in claim 5 wherein a number of said lines of said cavities are provided in parallel, wherein the blades of each line are attached to a handle portion.

8. The tool as claimed in claim 7 wherein said lines are connected to the handle portion by handle release means.

9. The tool as claimed in claim 6 wherein said rod release means comprise nuts and bolts.

10. The tool as claimed in claim 8 wherein said handle release means comprise nuts and bolts.

11. The tool as claimed in claim 5 wherein a variety of brick dimensions are formed by said cavities.

12. A wall facing patterning tool for forming a brickwork resembling layer in a wall facing of unset settable building material, the tool comprising:

a plurality of rigid blades formed from planar sheet material; and means for supporting the blades relative to one another;

the thickness of the sheet material defining the thickness of the blade;

the thickness of the blade being such that the blades can slice into said unset settable building material without significant compression of the building material so as to form a plurality of cut lines therein;

the blades are arranged to form a cavity for forming one brick of the brickwork resembling layer;

the blades are arranged to form a cavity having an integral base plate to form an open ended box.

13. The tool as claimed in claim 12 wherein the base plate includes apertures.

14. The tool as claimed in claim 2 further comprising a spirit level.

15. The tool as claimed in claim 2 wherein the blades comprise stainless steel.

16. The tool as claimed in claim 12 further comprising a spirit level.

17. The tool as claimed in claim 12 wherein the blades comprise stainless steel.

18. The tool as claimed in claim 5 further comprising a spirit level.

19. The tool as claimed in claim 5 wherein the blades comprise stainless steel.

* * * * *